United States Patent [19]

Ackermann

[11] 4,400,208

[45] Aug. 23, 1983

[54] PROCESS FOR THE PRODUCTION OF IRON, PHOSPHORUS, CARBON AND CHROMIUM BASED AMORPHOUS METAL ALLOYS, AND THE ALLOYS OBTAINED

[75] Inventor: Luc Ackermann, Pompey, France

[73] Assignee: Pont A Mousson S.A., Nancy, France

[21] Appl. No.: 351,689

[22] Filed: Feb. 24, 1982

[30] Foreign Application Priority Data

Feb. 27, 1981 [FR] France ..... 81 03978

[51] Int. Cl.[3] ..... C22B 33/08

[52] U.S. Cl. ..... 75/129; 75/123 B; 75/130 R; 148/31.55; 420/428

[58] Field of Search ..... 75/129, 130 R, 170, 75/171, 123 B; 148/31.55

[56] References Cited

U.S. PATENT DOCUMENTS 3,483,916 12/1969 Hard ..... 75/129

4,190,438 2/1980 Aso ..... 75/123 B 4,219,355 8/1980 DeCristofaro ..... 75/123 B

*Primary Examiner*—P. D. Rosenberg

*Attorney, Agent, or Firm*—Sughrue, Mion, Zinn, Macpeak & Seas

[57] ABSTRACT

A process for producing iron, phosphorus, carbon and chromium based amorphous metal alloys of the type in which a metal alloy in the liquid phase is cooled very rapidly to obtain a vitreous structure, wherein the liquid phase is prepared from cast iron, phosphorus and chromium. This process provides a low cost amorphous alloy as compared to that of crystalline products, and one which, however, possesses improved properties. The invention also relates to the amorphous alloy obtained having the following composition by atomic percentage: Cr: 1.5 to 8; C: 8 to 16; P: 4 to 12; Si: up to 3.5; the remainder being iron and the P/C ratio being less than 1.

11 Claims, No Drawings

PROCESS FOR THE PRODUCTION OF IRON, PHOSPHORUS, CARBON AND CHROMIUM BASED AMORPHOUS METAL ALLOYS, AND THE ALLOYS OBTAINED

This invention relates to a process for the production of iron, phosphorus, carbon and chromium based amorphous or vitreous metal alloys, as well as an alloy composition resulting therefrom.

From the work in 1958 by Pol Duwez at the California Institute of Technology, amorphous metal alloys have been known which are obtained by very rapid cooling of a liquid phase, thus providing for the retention of the disordered or non-crystalline structure. In effect, the material is directly brought to a temperature below a certain threshold, known as the vitrification temperature, which is considerably below that of solidification at which crystallization begins.

One technique for the production of amorphous metal alloys, known as hypertempering, consists of directing a jet of molten metal onto the surface of a rotating disc or cylinder whose temperature is maintained at below ambient. The liquid then spreads out on the disc as a skin of only a few microns thick. As the skin is extremely thin and in close contact with a heat source of much greater volume, and since the metals have considerable thermal conductivity, the metal cools and solidifies very rapidly, at a speed on the order of $10^6$° C./second.

In a particular embodiment, the jet of molten metal is impacted against the interior surface of a rapidly rotating hollow cylinder (Pond and Maddin, Trans. of Met. Soc., AIME, Vol. 245, p. 2475, 1969).

The skins or ribbons thus prepared possess remarkable properties, both mechanical and magnetic. The alloys have very high traction resistance, and their ductility is characterized by excellent bending properties, enabling curves having a radius on the order of the thickness of the ribbon to be achieved; they also have "soft" magnetic properties, i.e., they may be magnetized and demagnetized with a very weak field.

The first compositions of amorphous alloys were binary, based on gold and silicon. Numerous metallic compositions have been tried since then, but those likely to lead to an amorphous alloy by hypertempering are generally composed of a transition metal or an alloy of transition metals (iron, cobalt, nickel) or of a noble metal (gold, palladium, platinum) and a non-metal with low atomic radius (boron, silicon, phosphorus, carbon).

French Pat. No. 2,211,536 describes a composition of the MYZ type, wherein M is a metal selected from among iron, nickel, chromium, cobalt and vanadium or a mixture of these elements, Y is a non-metal selected from among phosphorus, carbon and boron and Z is an element selected from the group consisting of aluminum, silicon, tin, antimony, germanium, indium and beryllium. The various iron-based compositions must possess a high degree of purity, however, which constitutes a considerable cost disadvantage. Likewise, the iron-phosphorus-carbon alloy produced in accordance with the technique described in the Journal of Non-Crist. Solid. No. 5, 1970, p. 1, by Pol Duwez, is obtained by melting a 99% pure iron powder, pure red phosphorus and powdered electrode quality graphite carbon, said mixture undergoing sintering to form ingots.

The processes for the preparation of these amorphous metal alloys are therefore very expensive since they require the elementary metals constituting the alloy to be in their pure state.

Applicant has now discovered that, in a surprising manner, an amorphous metal alloy can be prepared using extremely common materials. An object of the invention is therefore to provide a process for the production of iron, phosphorus, carbon and chromium based amorphous metal alloys of the type in which a metal alloy in the liquid phase is cooled very rapidly to obtain a vitreous structure, wherein the liquid phase is prepared from cast iron, phosphorus and chromium.

According to a first embodiment the liquid phase is obtained by addition of phosphorus, at a rate of 3.8 to 11.5% by weight, and chromium, at a rate of 0 to 12% by weight, to liquid cast iron, the above percentages being calculated in relation to the cast iron.

Unless there is an indication to the contrary, the percentages given below for the proportions of the various elements are by weight.

According to a first alternative, phosphorus and chromium may be added simultaneously. According to a second preferred alternative, the phosphorus is added first to the liquid cast iron, the cast iron mixture obtained is cleaned, and then the chromium is added. According to a third alternative, the chromium is added first to the liquid cast iron, then the phosphorus is added.

In a second embodiment the liquid phase is prepared by simultaneous remelting of cast iron in the solid state and of from 0 to 12% by weight of chromium in the solid state, in relation to the cast iron, then from 3.8 to 11.5% by weight of phosphorus in the solid state is added, in relation to the cast iron. The phosphorus is preferably introduced in the form of an alloy such as ferrophosphorus, and the chromium is also in the form of an alloy such as ferrochromium.

It is thus possible to prepare an amorphous metal alloy from very standard industrial products, such as cast iron, without being forced to use pure or at least 99% pure elements, nor to use vacuum production techniques which avoids the formation of oxides, the dissolution of gases or the loss of volatile elements.

The invention is also directed to an amorphous alloy of the type containing iron, phosphorus, carbon and chromium, with the following composition by atomic percentage: Cr: 1.5 to 8; C: 8 to 16; P: 4 to 12; Si: up to 3.5; the remainder being iron and the P/C ratio being less than 1. The alloy thus obtained is characterized both by its ratio $P/C<1$, and by the presence of Si.

According to the first embodiment, the process of the invention consists of adding ferrophosphorus and ferrochromium to crude cast iron in the liquid state. By crude cast iron is meant cast iron which has undergone no particular treatment, such as desulfuration or dephosphoration, but which has been cleaned; however, cast iron may also be used which, in addition to cleaning, has undergone prior desulfuration or dephosphoration. This cast iron may, for example, be cast iron collected in a standard manner during high furnace casting. The cast iron is used in the liquid state directly from the high furnace or from a stocking mixer, or may be obtained by remelting ingots. The ferrophosphorus and ferrochromium are added in the form of commercial granules. During the additions, the cast iron is maintained in the liquid state by any appropriate means, such as induction, insufflation of oxygen, etc., at a temperature of between 1250° and 1450° C. The temperature is then brought to a value of between 1250° and 1350° C.

in order to avoid excessive loss of phosphorus. The yields of these additions vary between 80 and 97%, that is 90 to 97% for the ferrochromium and 80 to 97% for the ferrophosphorus.

The additions are carried out in the following proportions:

from 3.8 to 11.5% by weight of phosphorus in relation to the cast iron, for example in the form of 15 to 44% by weight of ferrophosphorus with a phosphorus content of approximately 26%;

from 0 to 12% by weight of chromium in relation to the cast iron, for example in the form of 0 to 17% by weight of ferrochromium with a chromium content of approximately 70%;

the remainder being cast iron.

When the second embodiment is employed, the starting material is an ingot of cast iron with the same characteristics as defined above, said ingot being remelted in the presence of ferrochromium in the form of commercial granules, so as to obtain the liquid phase of a mixture to which the ferrophosphorus is added.

The alloy thus obtained is either hypertempered directly or cooled and then hypertempered starting from ingots remelted at a temperature of between 1100° and 1300° C., using any known method, such as cooling on or in a roll, or even between two rolls if a ribbon is desired.

As previously indicated, the essential characteristic of the process is that the constituents of the starting mixture do not possess high purity.

Various types of cast iron have been used in which the carbon content is between 2 and 4.5%, a higher content leading to free graphite deposits on the amorphous ribbon obtained and a lower content being economically disadvantageous to the process since it is then necessary to add higher proportions of ferrophosphorus. The sulfur content is preferably less than 0.45%, which value already exceeds the normal amounts in common cast irons which have undergone no desulfuration treatment.

The quantity of silicon goes from traces to 5%, the limit above which it is very difficult to obtain a hypertempered product with the ribbons thus obtained becoming more and more brittle. The quantity of manganese goes from purity to 4%. Finally, the use of a very phosphorus cast iron, such as that obtained from a phosphorus ore of the type extracted from the Lorraine mines is very suitable as this type of cast iron has a phosphorus content of up to 1.65%. A cast iron with chromium, with a chromium content reaching 14%, may also be used.

By way of illustration, the elementary compositions for four cast irons which have been used are given below:

| Sample | C | P | S | Si | Mn | Cr | Sn | Al | Ni | Cu | Mo | V | Ti | As | Pb |
|---|---|---|---|---|---|---|---|---|---|---|---|---|---|---|---|
| 1 | 3.90 | 0.07 | 0.012 | 0.25 | 0.12 | 0.012 | 0.001 | 0.011 | 0.022 | 0.013 | | | | | |
| 2 | 4.01 | 0.02 | 0.010 | 1.30 | 0.06 | 0.122 | 0.011 | 0.011 | 0.020 | 0.015 | | | | | |
| 3 | 3.63 | 0.018 | 0.009 | 2.19 | 0.06 | 0.122 | 0.011 | 0.011 | 0.022 | 0.013 | 0.006 | 0.002 | | | |
| 4 | 3.98 | 0.067 | 0.007 | 1.77 | 0.22 | 0.015 | 0.014 | 0.003 | 0.013 | 0.035 | 0.006 | 0.014 | 0.051 | 0.003 | 0.012 |

Preferably the ferrophosphorus used as an addition element has the best possible phosphorus content which is compatible with commercial requirements, a minimum content of 15% being desirable. Preferably the ferrophosphorus does not contain more than 2.5% titanium which is a classical impurity since, above this value, the formation of titanium oxide perturbs tempering. Examples of ferrophosphorus compositions are given in the following table:

| Sample | P | Si | Mn | Ti | Cr | V | Fe |
|---|---|---|---|---|---|---|---|
| 1 | 26.60 | 0.12 | 0.54 | 0.45 | 0.20 | 0.25 | the remainder |
| 2 | 26.80 | 1.40 | 0.46 | 0.18 | 0.18 | 0.30 | the remainder |

The ferrochromium, which is the other preferred addition element in the process of the invention, is a commercial product preferably with a minimum chromium content of 50%, for example of approximately 70%, and possibly containing trace impurities such as manganese and magnesium, these impurities having no negative consequences since they are already present in the starting cast iron.

By hypertempering the above-defined mixture, an amorphous alloy having the above composition is obtained which comprises other elements as impurities, in particular manganese.

EXAMPLE 1

Using the first embodiment of the invention, 70% by weight of liquid cast iron corresponding to Sample 1 above was mixed with 23% solid ferrophosphorus corresponding to Sample 1 above, the mixture was then cleaned, and finally 7% solid ferrochromium containing 70% chromium was added, the various percentages being given in relation to the weight of the mixture. After hypertempering, the resultant amorphous alloy had the following composition (by atomic %):

| Fe | Cr | C | P | Si | Mn |
|---|---|---|---|---|---|
| 76.2 | 4.4 | 11 | 7.8 | 0.4 | 0.2 |

EXAMPLE 2

Still using the first embodiment, 65% by weight of liquid cast iron having a composition corresponding to that of Sample 2 was mixed with 26.4% solid ferrophosphorus corresponding to Sample 2. The mixture was cleaned and 8.6% solid ferrochromium containing 70% chromium was added, the percentages being given by weight in relation to the mixture. The alloy obtained had the following composition (by atomic %):

| Fe | Cr | C | P | Si | Mn |
|---|---|---|---|---|---|
| 69.5 | 5.3 | 11.9 | 9.8 | 2.5 | 1 |

EXAMPLE 3

Using the second embodiment of the invention, 65% solid cast iron having a composition corresponding to that of Sample 2 was remelted with 8.6% solid ferrochromium containing 70% chromium, then 26.4% solid ferrophosphorus corresponding to Sample 2 was added to the liquid mixture, the percentage being given by weight in relation to the mixture. The alloy obtained had the composition given in Example 2.

In its normal crystalline form, an alloy with a composition such as defined above is very hard and brittle and its mechanical properties are obviously bad. Traction resistance to breakage is less than 200 MPa. On the other hand, the cost of such material is low since its production requires only cast iron, which may be non-treated, to which modest quantities of ferrophosphorus and ferrochromium are added.

When rendered amorphous, this same alloy provides, for example, metal ribbons of theoretically unlimited length, with a thickness of less than 60 microns and a width of between 0.2 and several millimeters, at the same time having a low cost since it is obtained from the same starting materials.

By way of comparison, an amorphous alloy (A) with the following composition (by atomic %):

| Fe | Cr | C | P | Si | Mn |
|---|---|---|---|---|---|
| 76.2 | 4.4 | 11 | 7.8 | 0.4 | 0.2 |

corresponding to the first production example was submitted to various tests. Its recrystallization temperature was on the order of 470° C.; prior to recrystallization, it underwent a loss of ductility after treatment for 6 hours at 220° C.

A comparison of the mechanical characteristics of this alloy of composition (A) in its amorphous form and in its crystalline form is given in the following table:

| Alloys (at. %) | Vickers Hardness HV | Traction Resistance to Breakage $\sigma_r$ (MPa) | Youngs Modulus E (GPa) | Tenacity MPa $\sqrt{m}$ |
|---|---|---|---|---|
| A crystallized | 1200 | 200 (50 mm standardized sample) | 150 | — |
| A amorphous | 930 | 1900 (sample in the form of a ribbon of a length of 100 mm) | 140 | 32 |

What is claimed is:

1. A process for the production of an iron-based amorphous metal alloy containing phosphorus, carbon, chromium, and iron comprising:

(a) preparing a liquid phase by melting cast iron, phosphorus and chromium, and (b) rapidly cooling the resulting liquid phase metal alloy to obtain an amorphous structure.

2. The process of claim 1, wherein the liquid phase is obtained by the addition of phosphorus, at a rate of 3.8 to 11.5% by weight, and of chromium, at a rate of 0 to 12% by weight, to cast iron in a liquid state, said percentages being calculated in relation to the cast iron.

3. The process of claim 2, wherein the addition of phosphorus is carried out first, the mixture obtained is cleaned, and then the chromium is added.

4. The process of claim 2, wherein the addition of chromium is carried out first, then the phosphorus is added.

5. The process of claim 1, wherein the liquid phase is prepared by simultaneous remelting of cast iron in the solid state and of from 0 to 12% by weight of chromium in the solid state, in relation to the cast iron, then from 3.8 to 11.5% by weight of phosphorus in the solid state is added, in relation to the cast iron.

6. The process of any one of the preceding claims, wherein the cast iron used is a cleaned cast iron directly obtained during high furnace casting which has undergone no prior treatment.

7. The process of claim 1, wherein the cast iron used has a weight content of carbon of from 2 to 4.5%, of sulfur of less than 0.45%, of silicon of less than 5%, of manganese of less than 4% and is capable of being alloyed with chromium up to a content of 14%.

8. The process of claims 2 or 5, wherein the phosphorus is added in the form of ferrophosphorus having a minimum phosphorus content of 15%.

9. The process of claims 2 or 5, wherein the chromium is added in the form of ferrochromium having a minimum chromium content of approximately 50%.

10. The process of claim 2, wherein the addition of the ferrophosphorus and of the ferrochromium is carried out to cast iron maintained at a temperature of 1250° to 1450° C.

11. An iron-based amorphous metal alloy of the type containing iron, phosphorus, carbon and chromium having the following composition by atomic percentage:

Cr: 1.5 to 8; C: 8 to 16; P: 4 to 12; Si: up to 3.5; the remainder being iron and the P/C ratio being less than 1.

* * * * *